US006524262B1

(12) United States Patent
Akihiro

(10) Patent No.: US 6,524,262 B1
(45) Date of Patent: Feb. 25, 2003

(54) ORAL LIP AND CHIN MUSCLE REHABILITATING DEVICE

(75) Inventor: Yoshiaki Akihiro, Kokubunji (JP)

(73) Assignee: Actwell Technology, Inc., Taipei (TW)

( * ) Notice: Subject to any disclaimer, the term of this patent is extended or adjusted under 35 U.S.C. 154(b) by 0 days.

(21) Appl. No.: 09/698,025

(22) Filed: Oct. 30, 2000

(51) Int. Cl.[7] ..... A61H 1/02; A63B 23/00
(52) U.S. Cl. ..... 601/38; 482/11
(58) Field of Search ..... 482/11, 121, 127; 128/845, 861; 433/69

(56) References Cited

U.S. PATENT DOCUMENTS

| | | | | | |
|---|---|---|---|---|---|
| 1,714,029 | A | * | 5/1929 | Kuhn | |
| 1,851,865 | A | * | 3/1932 | Ptacek | |
| 3,813,096 | A | * | 5/1974 | Welch | 272/82 |
| 5,431,610 | A | * | 7/1995 | Miller | 482/11 |
| 5,562,105 | A | * | 10/1996 | Syrop et al. | 128/845 |
| 5,746,703 | A | * | 5/1998 | Levatino | 601/38 |
| 6,203,471 | B1 | * | 3/2001 | Akihiro | 482/11 |

* cited by examiner

*Primary Examiner*—Stephen R. Crow
(74) *Attorney, Agent, or Firm*—Troxell Law Office PLLC

(57) ABSTRACT

Oral lip and chin muscle rehabilitating device made of flexible material and having an annular open shape in accordance with the configuration of human oral lips. One side of the upper edge of the opening is formed with a recessed upper lip rest section extending outward and upward. One side of the lower edge of the opening is formed with a recessed lower lip rest section extending outward and downward. The upper and lower lip rest sections respectively receive therein the upper and lower lips of a user. A resilient connecting section is connected between the upper and lower lip rest sections to provide a certain resilient stretching force therefor. The oral lip and chin muscle rehabilitating device is positioned between the upper and lower lips of the user to rehabilitate and train the lip and chin muscle and recover the closing function of the lips. A resilient member is retained between the outer sides of the upper and lower lip rest sections so as to provide an auxiliary resilient stretching force between the upper and lower lip rest sections. The resilient member is replaceable so that one single rehabilitating device can be co-used with different resilient members with different resilient stretching force in accordance with different users or treatment progresses.

6 Claims, 4 Drawing Sheets

ORAL LIP AND CHIN MUSCLE REHABILITATING DEVICE

BACKGROUND OF THE INVENTION

The present invention relates to an oral lip and chin muscle rehabilitating device which is able to stretch and train the muscle around the mouth of a user. The rehabilitating device is applicable to those patients suffering difficulty in chewing, swallowing or speaking caused by injury, stroke or other reasons. The rehabilitating device is able to quickly recover the normal functions of those patients. Especially, a replaceable resilient member is additionally disposed between the upper lip rest section and lower lip rest section. Therefore, the pressing and mating load between the upper lip rest section and lower lip rest section can be varied so as to meet the requirements of different treatments or different users.

A cerebral disease patient often suffers monoplegia. Such patient will unconsciously drivel, drop food during chewing, swallow hard and speak unclearly. Therefore, such patient must be treated by rehabilitation of the muscle around the oral cavity. However, there has been no suitable auxiliary rehabilitation implement long since so that the muscle around the oral cavity can be hardly effectively rehabilitated. In order to solve the above problem, the applicant's U.S. patent application No. 09/396,373 discloses an oral lip and chin muscle rehabilitating device for rehabilitating the muscle around the oral cavity. The device includes an upper lip rest section, a lower lip rest section and a resilient connecting section integrally connected therebetween. The resilient force of the connecting section is able to properly increase the load on the muscle of the lips and chins so as to easily effectively rehabilitate the muscle around the oral cavity. However, according to the above device, it is necessary to adjust the resilient load between the upper lip rest section and lower lip rest section after each treatment. This leads to inconvenience in use and increases the cost of the user.

SUMMARY OF THE INVENTION

It is therefore a primary object of the present invention to provide an improved oral lip and chin muscle rehabilitating device for rehabilitating the muscle around the oral cavity. In the device, a replaceable resilient member is additionally disposed between the upper lip rest section and lower lip rest section. Therefore, the pressing and mating load between the upper lip rest section and lower lip rest section can be varied by replacing the resilient member so as to meet the requirements of different treatment progresses or different users.

The present invention can be best understood through the following description and accompanying drawings wherein:

DETAILED DESCRIPTION OF THE PREFERRED EMBODIMENTS

Figure 1:
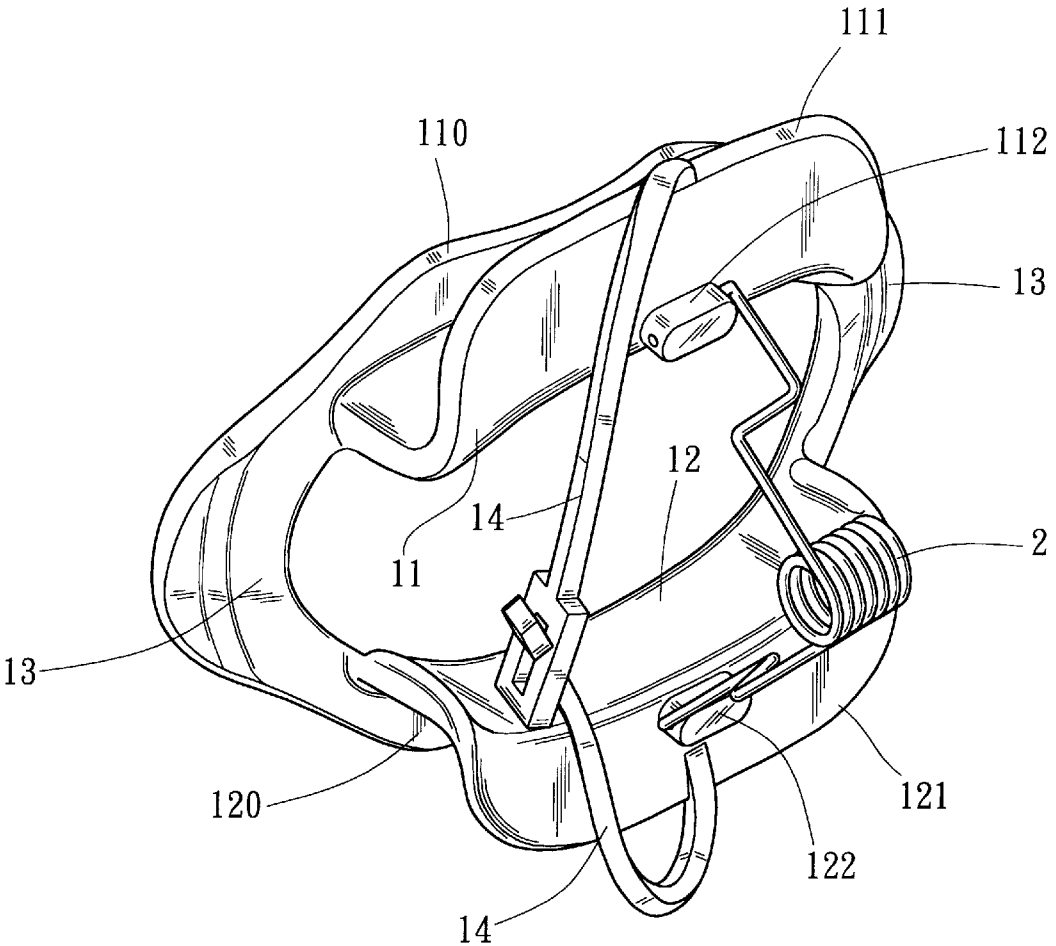
FIG. 1 is a perspective view of a preferred embodiment of the present invention.
Figure 2:
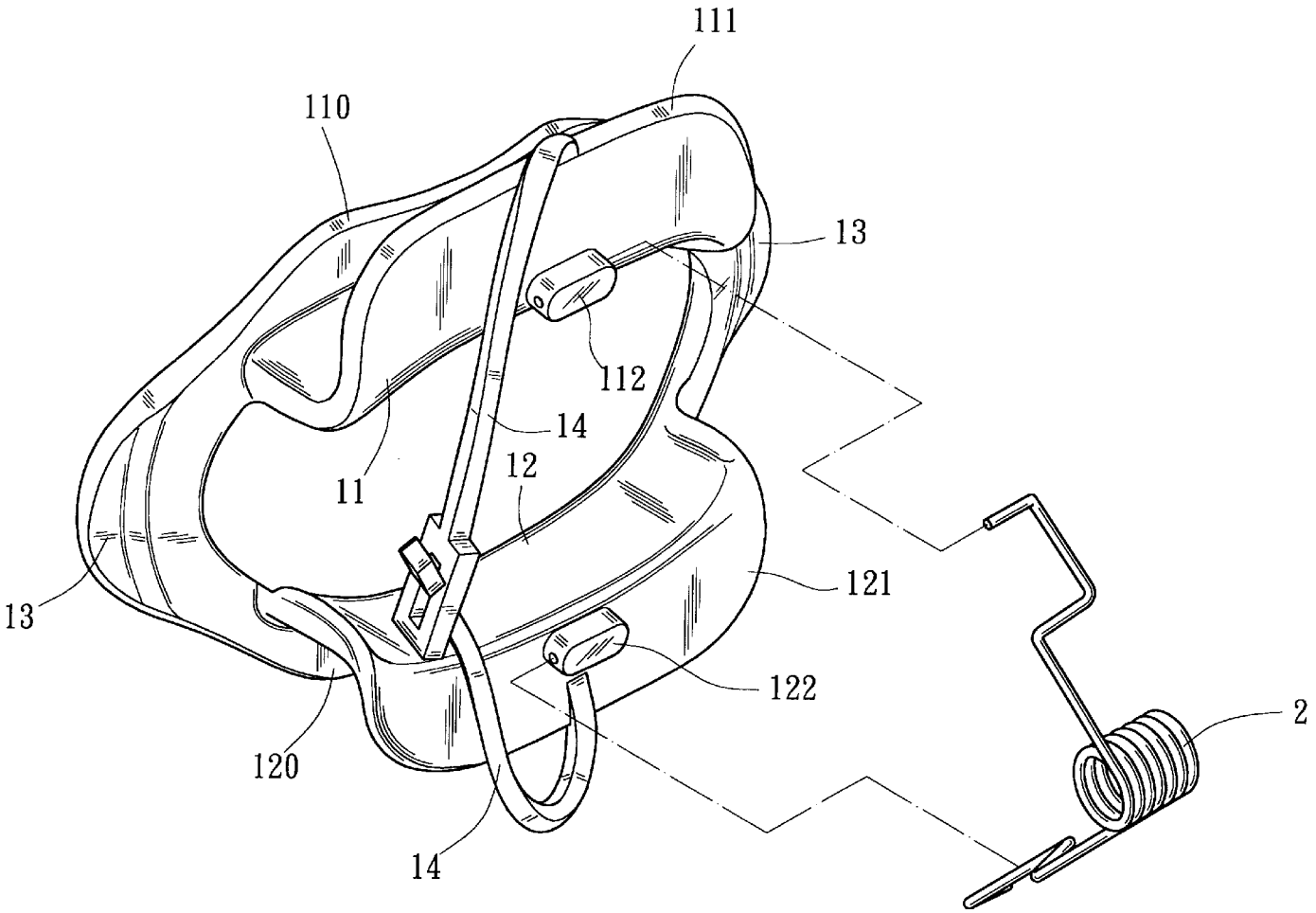
FIG. 2 is a perspective exploded view according to FIG. 1.
Figure 3:
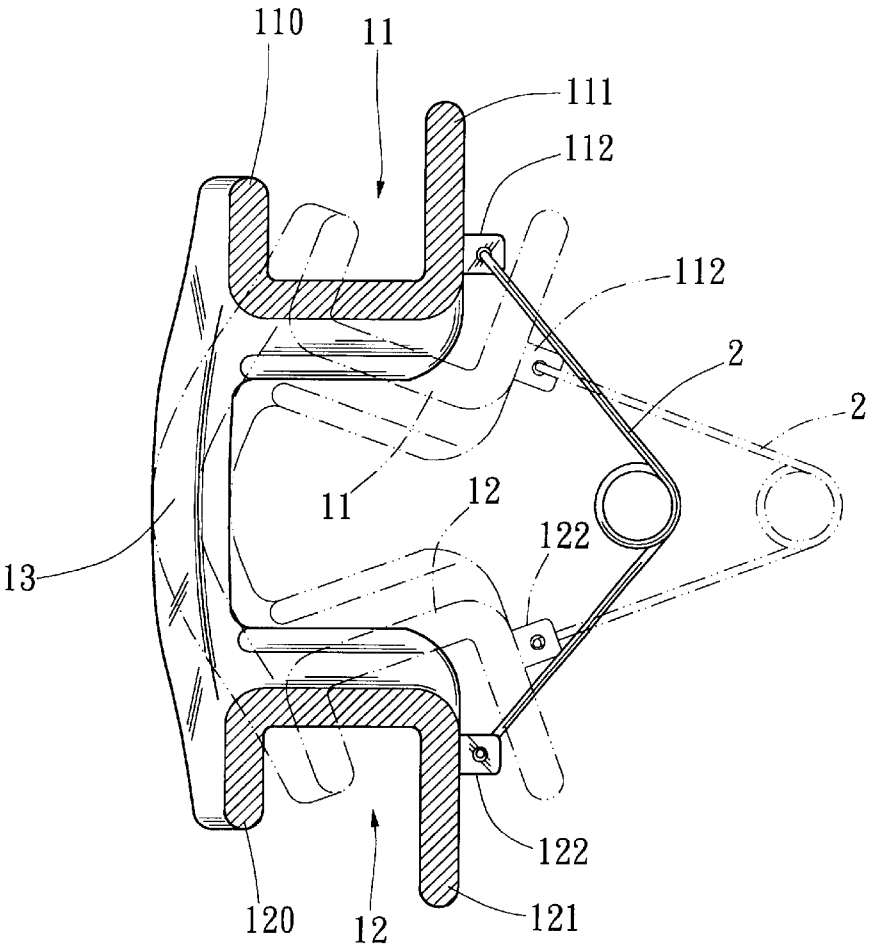
FIG. 3 is a cross-sectional view of the embodiment of FIG. 1.
Figure 4:
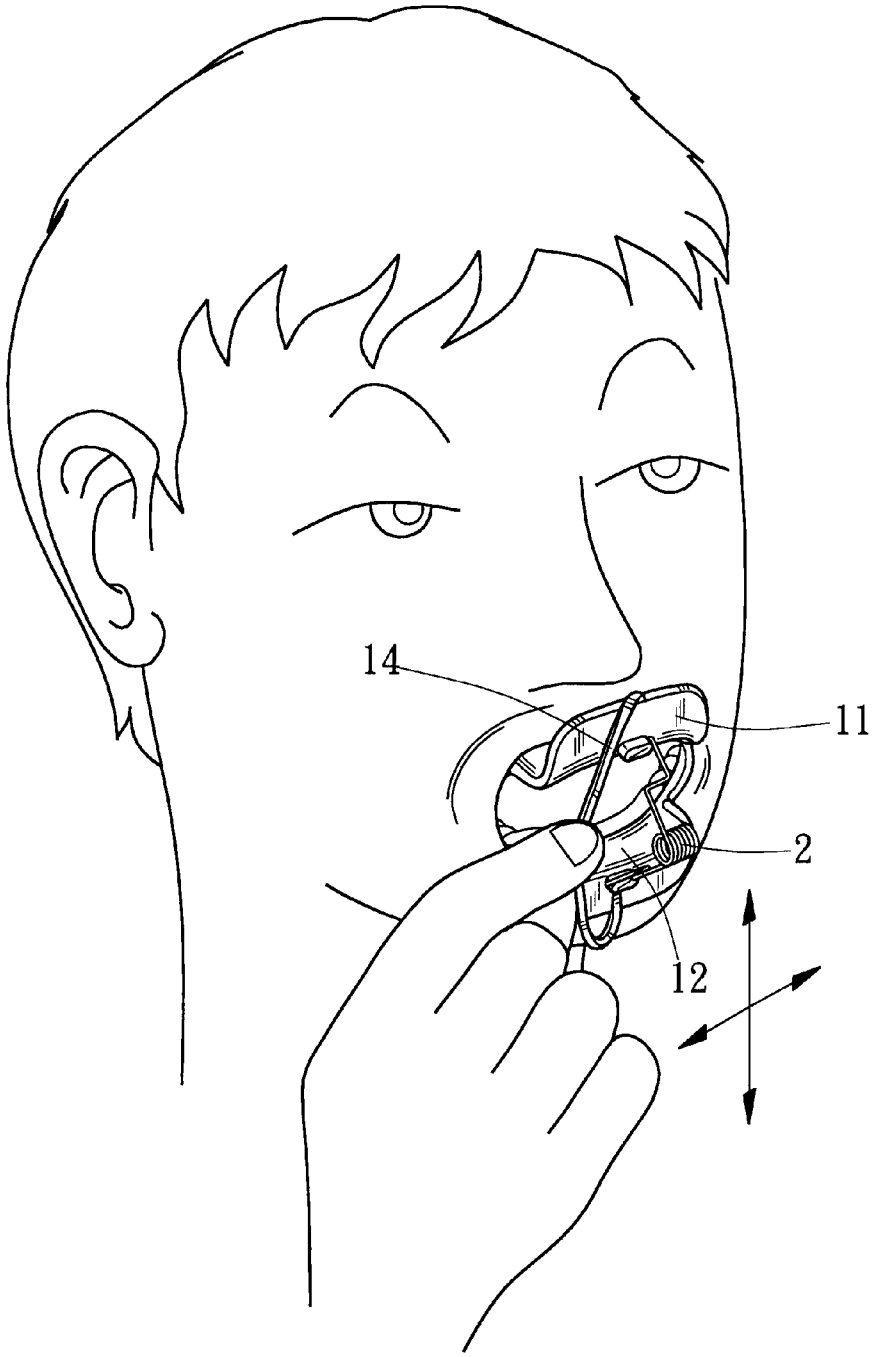
FIG. 4 shows the use of the present invention.

Please refer to FIGS. 1 to 4. The oral lip and chin muscle rehabilitating device of the present invention is a resilient plate body integrally made from resilient synthetic resin (such as silicone, polythylene resin and rubber). The oral lip and chin muscle rehabilitating device has a profile in accordance with the configuration of human oral lips, including an upper lip rest section 11 and a lower lip rest section 12 and a connecting section 13 connected therebetween. The inner sides 110, 120 of the upper and lower lip rest sections 11, 12 are respectively extended outward by a certain distance and then reversely turned to form folds 111, 121 opposite to each other. Two lateral sides of the peripheries of the upper and lower lip rest sections 11, 12 are connected by the connecting section 13. In addition, two insertion sections 112, 122 are respectively disposed between outer sides of the upper and lower lip rest sections 11, 12. Two ends of an extensible resilient member 2 can be inserted into the two insertion sections 112, 122. The resilient member 2 serves to provide a resilient stretching force between the upper and lower lip rest sections 11, 12 to increase the pressing and mating load. A conducting strap 14 can be connected between the upper and lower lip rest sections 11, 12. The conducting strap 14 has two segments respectively extending from the upper and lower lip rest sections 11, 12. The two segments can be fastened with each other or separated from each other.

In use, the centers of the upper and lower lip rest sections 11, 12 are pressed and held with fingers to compress flat the orally shaped plate body to an extent suitable for placing into the mouth. Then the plate body is laterally turned by 90 degrees to place one side thereof into the oral cavity. Thereafter, the plate body is turned back into a horizontal state. After the connecting section 13 at one lateral end of the periphery is placed into one side of the oral cavity, the plate body is further pushed in a direction in which the plate body is placed in so as to place the connecting section 13 at the other lateral end into the other side of the oral cavity and respectively firmly retain the connecting section 13 between the front sides of two chins and the teeth in the oral cavity. By means of the stretching force of the structure, the oral lips are stretched open. In this state, a suitable resilient stretching force is provided for the oral lip portion and a user can practice the pressing and mating strength of the oral lips so as to train the muscle of the oral lips and chins. Therefore, a patient can use the special design to rehabilitate and restore the oral cavity function. The resilient member 2 is replaceably inserted in the insertion sections 112, 122. Therefore, when it is necessary to adjust the closing load between the upper and lower lip rest sections 11, 12, it is no more necessary to replace the entire rehabilitating device and the user only needs to replace the resilient member with another one having different resilient force. Therefore, the use is more convenient and the cost can be reduced.

In biting, the user can hold the conducting strap 14 with hand to directly pull the device back and forth, up and down and left and right so as to stimulate the muscle around the lips. Moreover, after wearing the device, the user can bite and mate the teeth. Under such circumstance, the resilient force of the connecting section can stretch and train the muscle around the lips so as to achieve a rehabilitation effect.

With the oral lip device, the user can also perform up and down exercise of the upper and lower lips. For example, the upper and lower lip rest sections 11, 12 can be closed continuously for 2–4 minutes. This exercise is applicable to those patient suffering OSAS. At this time, the muscle around the lips is pulled to resist against the resilient force of the connecting section. Therefore, the muscle is trained.

Several effects can be achieved by training the muscle around the mouth as follows:

1. Rehabilitation Effect (recovering the movement function of a patient suffering monoplegia caused by stoke, cerebral embolism, etc.):

The patient suffering paralysis of half side of the tongue caused by stroke can wear the oral lip device for mouth shutting training. The other half of the tongue free from the paralysis will be naturally lifted. At this time, the paralyzed half of the tongue will be driven and lifted. Accordingly, the paralyzed half of the tongue can be rehabilitated without using strength so as to gradually recover the functions of pronouncing, forming food block and swallowing.

2. Disease Preventing Effect:

The position of the tongue is the main reason for OSAS. In general, the lingual apex is positioned near the upper jaw incisors. The oldening of the tongue muscle will lead to failure of the muscle and make it difficult to place the tongue at the normal position.

3. Cosmetic Effect:

A user can wear the above device and exercise. When resiliently closed, the device will pull the oral muscle and increase the load on the oral muscle and also drive the facial muscle (upper lip lifting ligament and lower lip restricting ligament) so as to train the muscle. Therefore, the profile of the face can be more highlighted.

4. Replaceable Resilient Member:

The resilient member is replaceable. Therefore, one single rehabilitating device can be durably used and it is unnecessary to prepare multiple sets of rehabilitating devices in accordance with the progress of the user. Therefore, the cost is saved and the management is facilitated.

In conclusion, the oral lip and chin muscle rehabilitating device of the present invention is able to improve and recover the oral functions of the patients suffering disturbance in chewing, swallowing and speaking. The resilient member is replaceably co-used with the rehabilitating device so that the using life of one single rehabilitating device is prolonged.

What is claimed is:

1. An oral lip and chin muscle rehabilitating device comprising:

a) an upper lip rest section having a generally U-shaped cross-sectional configuration with an upper fold having an upper outer side;

b) a lower lip rest section (12) having a generally U-shaped cross-sectional configuration with a lower fold having a lower outer side;

c) connecting sections connecting the upper and lower lip rest sections together at each opposite lateral sides thereof so as to form an opening between the upper and lower lip rest sections; and, d) a resilient member replaceably attached to the upper and lower outer sides of the upper and lower folds so as to extend across the opening; wherein the lip rest sections are located between the connecting sections and the resilient member.

2. The oral lip and chin muscle rehabilitating device of claim 1 wherein the resilient member comprises a torsion coil spring.

3. The oral lip and chin muscle rehabilitating device of claim 2 further comprising:

a) a first insertion section of the upper outer side; and, b) a second insertion section on the lower outer side, wherein opposite ends of the torsion coil spring are replaceably attached to the first and second insertion sections.

4. The oral lip and chin muscle rehabilitating device of claim 1 further comprising:

a) a first insertion section on the upper outer side; and, b) a second insertion section on the lower outer side, wherein the resilient member is replaceably attached to the first and second insertion sections.

5. The oral lip and chin muscle rehabilitating device of claim 1 further comprising a conducting strap extending from the upper and lower lip rests.

6. The oral lip and chin rehabilitating device of claim 5 wherein the conducting strap comprises:

a) a first segment extending from the upper lip rest; and, b) a second segment extending from the lower lip rest, wherein the first and second segments are releasably connected together.

* * * * *